United States Patent [19]

Piat

[11] 4,160,439

[45] Jul. 10, 1979

[54] CUTTING-OFF MACHINE FOR HARD BODIES

[75] Inventor: Jean Piat, La Varenne-St-Hilaire, France

[73] Assignee: Sotarem S.A., Fribourg, Switzerland

[21] Appl. No.: 880,982

[22] Filed: Feb. 24, 1978

Related U.S. Application Data

[63] Continuation of Ser. No. 739,722, Nov. 4, 1976, abandoned.

[30] Foreign Application Priority Data

Nov. 7, 1975 [CH] Switzerland ..... 14405/75

[51] Int. Cl.[2] ..... B28D 1/06

[52] U.S. Cl. ..... 125/16 R; 125/21

[58] Field of Search ..... 125/12, 16 R, 21

[56] References Cited

U.S. PATENT DOCUMENTS

| | | | |
|---|---|---|---|
| 2,674,238 | 4/1954 | Dessureau | 125/21 |
| 3,435,815 | 4/1969 | Focier | 125/16 R |
| 3,599,623 | 8/1971 | Phy | 125/21 |
| 3,831,576 | 8/1974 | Moch | 125/21 |

FOREIGN PATENT DOCUMENTS

| | | | |
|---|---|---|---|
| 2252048 | 5/1974 | Fed. Rep. of Germany | 125/21 |
| 771622 | 3/1957 | United Kingdom | 125/21 |

*Primary Examiner*—Harold D. Whitehead

*Attorney, Agent, or Firm*—Young & Thompson

[57] ABSTRACT

The invention relates to a machine for cutting hard bodies, characterized by the fact that it comprises two power-driven rotatable drums with parallel axes, each provided with a helical groove on its peripheral surface. An abrasive metallic wire is wound on both drums in order to form at least a layer of parallel wires. One end of the wire is wound on a feeding spool and the other end on a receiving spool; and the feeding and receiving spools are power driven in rotation.

5 Claims, 9 Drawing Figures

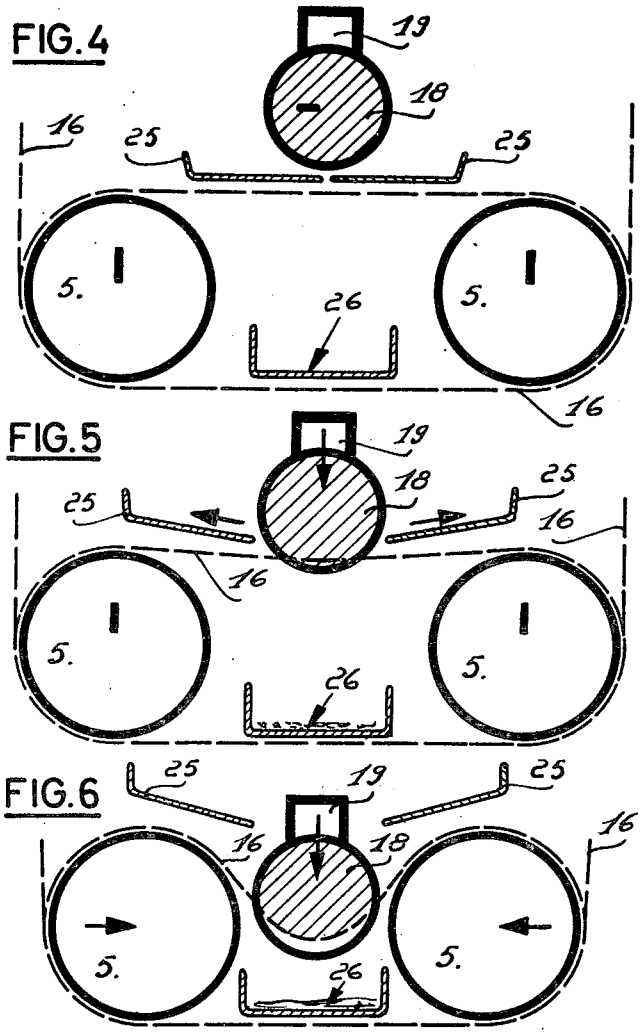
FIG.4
FIG.5
FIG.6
16
25
26
18
19
5.
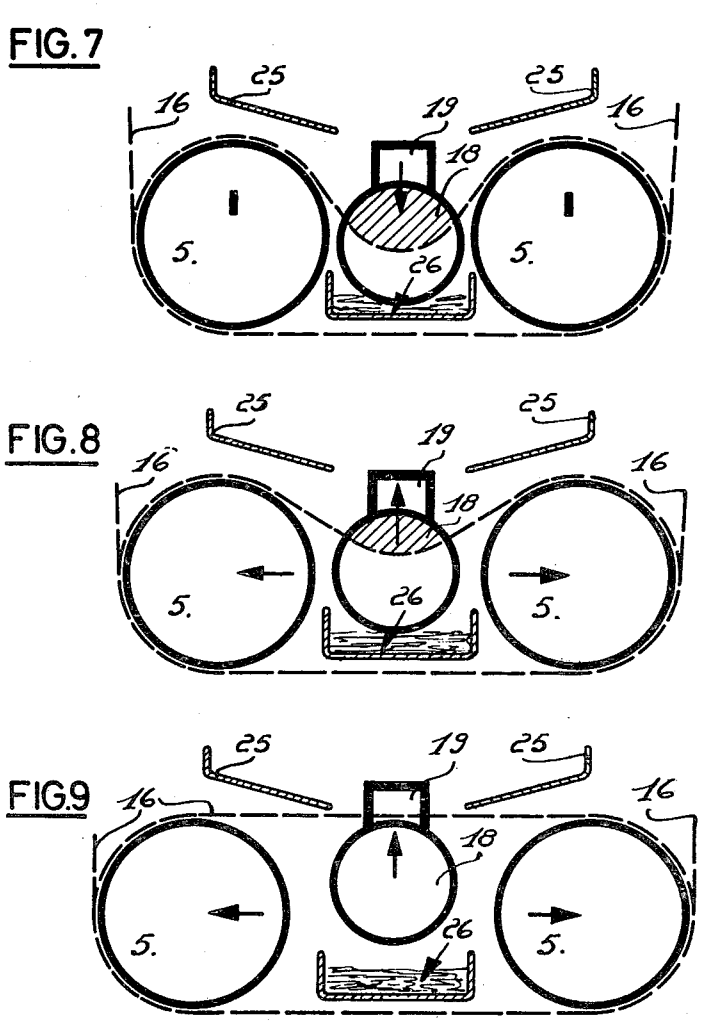
FIG.7
FIG.8
FIG.9
16
25
26
18
19
5.

CUTTING-OFF MACHINE FOR HARD BODIES

This is a continuation of application Ser. No. 739,722 filed Nov. 4, 1976 and now abandoned.

The present invention relates to cutting machines for hard bodies such as cutting-off machines for example. There are machines for cutting hard bodies which incorporate an abrasive disc driven in rotation and allowing a hard body to be cut off. The disadvantage of these known devices resides in the thickness of the disc, of the order of one millimeter, causing an important loss of the material to be cut, which, in the case of expensive or rare materials, results in an onerous loss. Moreover, these devices are poorly productive since only one piece can be cut off in one operation.

The object of the present invention consists in providing a machine for cutting hard bodies which tends to eliminate the aforesaid drawbacks and which is characterized by the fact that it comprises two rotating drums with parallel axes, each provided with an helical groove on its peripheral surface; driving means for rotating these drums; an abrasive metallic wire wound around both drums in order to form at least a layer of parallel wires; each end of the wire being wound on a feeding spool and the other end of a receiving spool, and by the fact that it further comprises means for driving in rotation said both spools.

The attached drawings schematically illustrate as example one embodiment of the machine for cutting hard bodies according to the invention.

FIGS. 4 to 9 are schematic views showing the successive steps of a cutting operation.

Figure 1:
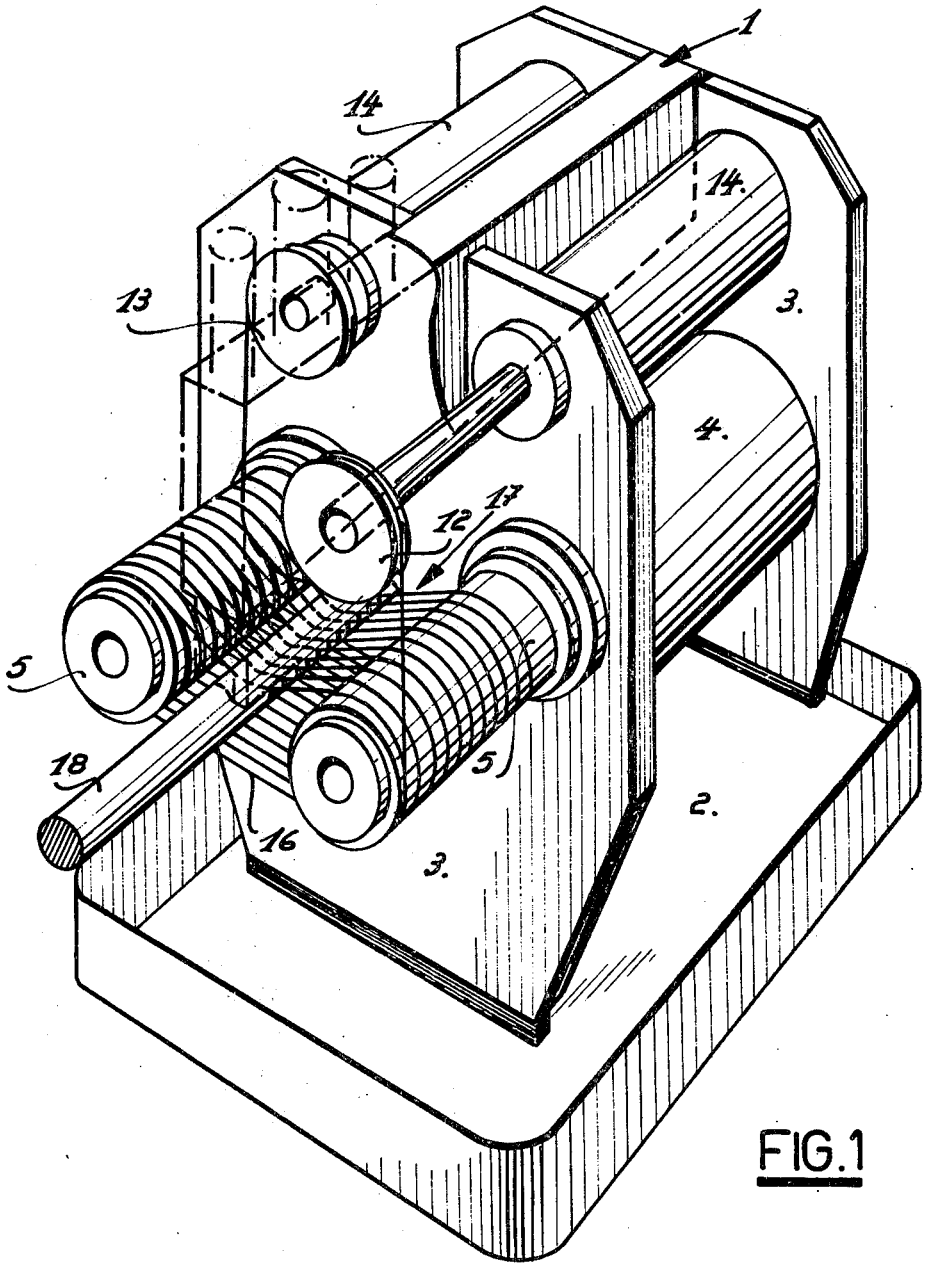
FIG. 1 is a perspective view thereof.
Figure 2:
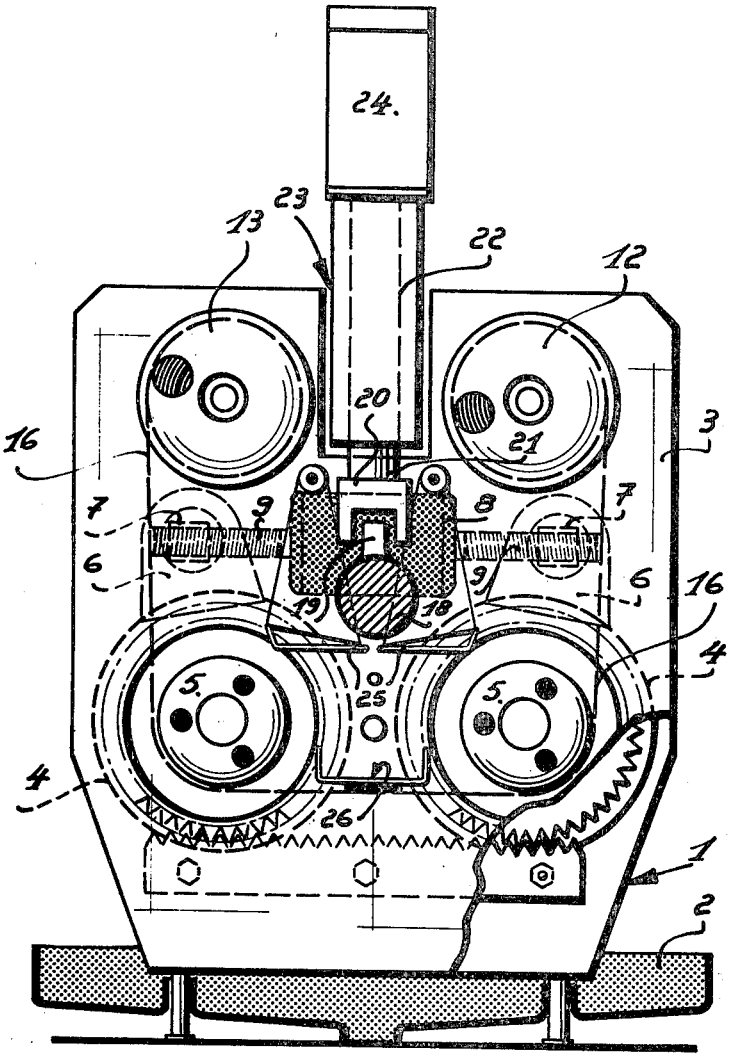
FIG. 2 is a front view thereof.
Figure 3:
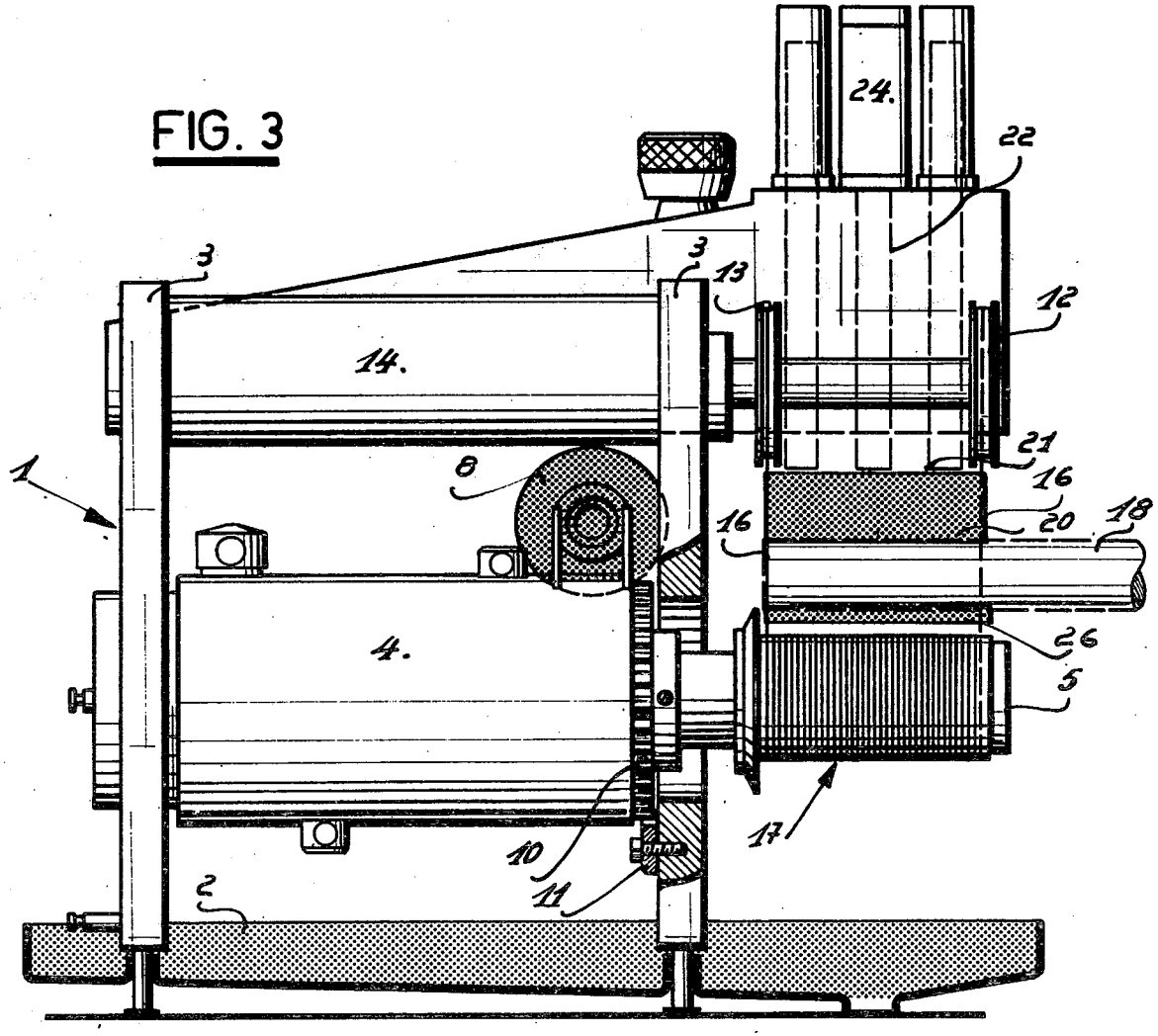
FIG. 3 is a side view thereof.

The machine shown comprises a frame 1, provided with a trough 2, which supports all fixed and moving elements of the cutting-off machine. This frame comprises two platens 3 with machined surfaces and being used as a support for the other elements of said machine.

Two low-inertia and high output motors 4, for example of the type P 815, 50 cps - 220/380 V four poles and 12 kw, are mounted between the platens 3 so as to have their driving shafts extending horizontally and in the same horizontal plane. In another embodiment, these motors 4 can move one with respect to the other in this horizontal plane against the action of an elastic pull-back device (not shown) in order to modify the centre distance of their driving shafts.

In the embodiment shown, each motor 4 is provided on the top of its case with brackets 6 in which are pivoted nuts 7 having a threaded boring. A stepping motor 8, fixed to the frame 1, drives in rotation two screws threaded in opposite directions and which are engaged with the nuts 7. Each motor 4 carries a toothed segment 10 in mesh with a rack 11 held by one or both platens 3. This enables thus the centre distance of the motor shafts to be varied by actuating the stepping motor 8.

Each motor shaft carries a cylindrical drum 5, the peripheral surface of which is provided with a helical groove with a pitch ranging from 1/20 th to one millimeter.

This helical groove can take the form of a triangular or concave thread whose depth corresponds approximately to its pitch.

The machine also comprises a take-off or feeding spool 12 and a take-up or receiving spool 13, each mounted on the shaft of a motor 14 rigidly fixed between the platens 3. These motors 14 are, for instance, of type P 612, each developing a torque of 20 kgcm.

The spools 12 and 13 are mounted on the respective shafts of the motors 14 so as to be rotated by them, while being able to slide longitudinally on these shafts. The axial position of said spools 12 and 13 on said shafts of the motors 14 can be fixed by a locking device (not shown).

An abrasive metallic wire 16, for example as described in Swiss patent application No. 13.987/75, that is comprising one or several helical grooves containing diamond granules, is fixed at one end to the take-off spool 12 and, then, wound around both drums 5 in helical grooves thereof, so as to form at least a layer of parallel wires 17. The other end of the abrasive wire 16 is fixed to the take-up spool 13.

The upper layer 17 of wires can comprise up to 500 parallel strands inclined at a slight angle to the axis of the drums 5. The distance between two strands of the wires layer 17 depends, of course, on the diameter of the abrasive wire, as well as on the pitch of the grooves on the drums 5. This distance can vary, for instance, from 1/20 th to 1 millimeter.

The machine further comprises a supporting and guiding device for the piece to be cut off, which generally takes the form of a rod or an elongated cylinder 18. Said piece 18 to be cut off is maintained on a guide 19 sliding in a hollow rail 20 mounted on one or several columns 21 moving vertically in a support 22 fixed in slots 23 of the platens 3. These columns 21 are driven vertically by a stepping motor 24 fixed on the support 22, and through a screw connection.

The piece 18 to be cut off can thus be displaced vertically toward the layer 17 of wires with its longitudinal axis being perpendicular, or approximately perpendicular, to the strands of said layer 17.

Furthermore, this machine comprises a sprinkling and lubricating device having two movable plates 25 allowing a liquid to be dispensed over the layer 17 of wires near the piece 18 to be cut off, and a collecting fan 26. A circulating, fillering and refrigerating circuit is provided for said liquid.

The operation of the machine for cutting hard bodies according to the invention is as follows:

A piece 18 to be cut off is fixed in its support and with the width of the layer 17 of wires corresponding to the length of said piece, the following operations are carried out:

(a) The machine being set up as schematically shown on FIG. 4, the motors 4 and 14 are started, both rotating in the same direction. This induces the travelling of the abrasive wire resulting in a relative movement, in the direction of the abrasive wire, between the piece to be cut off and the layer 17 of wires. A braking and automatically reversing device (not illustrated) controls the reverse movement of the wire when the take-off or feeding spool 12 is practically completely uncoiled. Thus, a reversing displacement of the wire length is obtained between the spools 12 and 13.

(b) The sprinkling device is actuated, and the liquid is distributed over the plates 25 and, therefrom, over the layer 17 of wires. The liquid is collected in the fan 26 and recuperated for further use.

(c) The stepping motor 24 is run at a speed or at a number of pulses per second determined as a function of the desired feeding speed of the piece to be cut off. This causes the displacement of said piece 18 toward the layer 17 of wires and, through a mechanical connection (not shown), the withdrawal of one plate 25 from the other plate 25. The piece 18 comes into contact with the strands of the layer 17 of wires, as shown in FIG. 5. Each wire of said layer acts like a circular saw and penetrates the piece to be cut.

(d) The stepping motor 24 keeps feeding the piece; the stepping motor 8 is energized in order to bring the drums 5 closer so as to obtain a partial envelopment of the piece by the layer of wires and, thereby, a greater contacting length of said wires with the piece. This leads to a quicker cutting action of the piece (see FIG. 6).

(e) The motor 8 is de-energized and the centre distance of the drums 5 is kept constant during a part of the cutting operation (FIG. 7). The piece has now reached its lower position and the motor 24 is de-energized. The piece is thus maintained in its low position, disposed partially within the fan 26.

(f) The motor 8 is energized again, but so as to cause both drums 5 to move apart. This causes a traction force on the stands of the layer 17 of wires and tends to displace them upward (FIG. 8).

(g) The piece is now fully cut off (FIG. 9), the drums 5 have returned to their position shown in FIG. 4 and the motor 24 is energized in order to raise the cut off piece. Said piece has been cut in only one operation into a number of slices equal to the number of strands included in the layer 17. These slices are then removed from the support 19. Upon completion of the cycle, the machine returns to the position illustrated on the FIG. 4.

It is obvious that quite a number of variants can be envisaged for the mechanical realization of the machine according to the invention. However, the present invention has two fundamental advantages with regard to the known devices, i.e.:

1. The fact that a great number of cuts, up to 500, can be made in a single opration, ensuring a large saving in time.
2. The fact that the material scrap and the rejects are minimized. Indeed, the diameter of the cutting wire can be as small as 1/10 th of a millimeter, whilst the thickness of the conventional cutting discs is not less than one millimeter.

Experiments carried out with such a machine have proved that the following functioning characteristics can easily be obtained:

- Reverse coiling of the wire comprised between 5 and 20 seconds for a wire length of 50 to 200 meters.
- Linear cutting speed of the order of 8 meters per second.
- Pressure exerted by the piece to be cut on the layer of wires ranging from 250 to 750 gram-decimeters per wire, depending on the material to be cut.
- Admissible diameter of the piece to be cut up to 100 millimeters.
- Admissible length of the piece to be cut up to 200 millimeters.
- Number of simultaneous cuts up to 500 slices.
- Required cutting time in the range of 80 to 120 minutes, depending on the material to be cut.
- The flatness accuracy of the cut faces is better than 10 microns.
- The cut faces of the slices are parallel within less than 20 microns. Furthermore, it is to be noted that an orientation device can be provided for the column 22 so as to enable the piece to be cut to be orientated angularly with regard to the layer of wires. It is thus possible to obtain oblique cuts by varying the angle from 0° to 50°, approximately.

Winding the abrasive wire, for instance when it is to be changed, requiring a short time as compared with the actual working time of the wire, it has therefore not been motorized. A simple and efficient manual coiling device allows this operation to be carried out rapidly and without difficulty.

A shaped screw-holding crank and the take-off or feeding spool are placed in the tapped hole with its positioning finger.

Before winding, the slide-holding arm 20 is raised.

The wire coming off the shaped guide is fixed by the gripper of the spool 12.

The motor of this spool is energized and 50 to 100 meters of wire are wound on said spool. Then, the current is switched and the spool stops, being locked by its brake.

Now, the operator actuates the crank manually until the end of 200–400 meters, and the wire finds its place with precision in the grooves of the drum.

At the last turn, the operator attaches the wire to the gripper of the spool 13 and cuts the wire.

Now the machine is ready to work, the preset traction force of the wire being automatically obtained by means of the torque motors, the compensation springs of which maintain said traction force even when the current is switched off.

I claim:

1. A machine for cutting hard bodies, comprising a pair of rotatable drums with parallel axes, each said drum having a grooved peripheral surface, a motor individual to each said drum for reversibly driving said drums in rotation, an abrasive metal wire wound on both drums to produce at least one layer of parallel strands of wire extending between said drums, a feeding spool on which one end of said wire is secured, a receiving spool on which the other end of said wire is secured, means for reversibly driving in rotation said feeding and receiving spools, a support for an elongated hard body to be cut, said support comprising means for mounting said elongated body with its axis parallel to the plane of said layer and transverse to said strands of said layer, means for moving said support toward said layer in a direction perpendicular to the plane of said layer, and means selectively to move said drums and motors simultaneously toward each other or simultaneously away from each other, thereby to permit said hard body to deflect said strands from said plane of said layer a predeterminably variable distance at different times during the cutting of said hard body.

2. A machine as claimed in claim 1, said support being disposed above said hard body, and said moving means moving said support downwardly to drive said hard body through said layer of wires from above.

3. A machine as claimed in claim 1, said means for moving said drums and motors comprising a rack engaging with toothed pinions one on each of said motors coaxial with the associated said drum, and means for simultaneously bodily rotating said motors in opposite directions whereby said toothed pinions and hence said motors move toward and away from each other.

4. A machine as claimed in claim 3, in which said motor rotating means comprises a stepping motor driving two screws with reverse thread and engaging nuts carried one by each of said motors.

5. A machine as claimed in claim 1, and means for dispensing liquid over at least a portion of said layer of wires and for recovering said liquid.

* * * * *